US008033333B2

(12) United States Patent
Frazier et al.

(10) Patent No.: US 8,033,333 B2
(45) **Date of Patent: *Oct. 11, 2011**

(54) DOWNHOLE PERFORATION TOOL

(75) Inventors: W. Lynn Frazier, Corpus Christi, TX (US); Garrett Frazier, Corpus Christi, TX (US)

(73) Assignee: W. Lynn Frazier, Corpus Christi, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/984,514

(22) Filed: Jan. 4, 2011

(65) Prior Publication Data

US 2011/0094745 A1 Apr. 28, 2011

Related U.S. Application Data

(63) Continuation of application No. 11/851,536, filed on Sep. 7, 2007, now Pat. No. 7,861,785.

(60) Provisional application No. 60/846,920, filed on Sep. 25, 2006.

(51) Int. Cl.
*F42D 1/00* (2006.01)

(52) U.S. Cl. ..... 166/299; 166/63

(58) Field of Classification Search ..... 166/297, 166/299, 308.1, 63; 102/313, 322
See application file for complete search history.

(56) References Cited

U.S. PATENT DOCUMENTS

| | | | | |
|---|---|---|---|---|
| 3,270,668 | A | 9/1966 | Silver | |
| 3,618,521 | A | 11/1971 | Montesi | |
| 4,081,031 | A | 3/1978 | Mohaupt | |
| 4,349,071 | A | 9/1982 | Fish | |
| 4,391,337 | A | 7/1983 | Ford et al. | |
| 4,687,063 | A | 8/1987 | Gilbert | |
| 5,598,891 | A | 2/1997 | Snider et al. | |
| 6,006,833 | A | 12/1999 | Burleson et al. | |
| 6,082,450 | A | 7/2000 | Snider et al. | |
| 6,098,716 | A | 8/2000 | Hromas et al. | |
| 6,138,753 | A | 10/2000 | Mohaupt | |
| 6,167,957 | B1 | 1/2001 | Frazier | |
| 6,263,283 | B1 | 7/2001 | Snider et al. | |
| 6,412,388 | B1 | 7/2002 | Frazier | |
| 6,817,298 | B1 | 11/2004 | Zharkov et al. | |
| 6,851,471 | B2 | 2/2005 | Barlow et al. | |
| 6,966,378 | B2 | 11/2005 | Hromas et al. | |
| 7,067,445 | B2 | 6/2006 | Webber et al. | |
| 7,073,589 | B2 | 7/2006 | Tiernan et al. | |
| 7,353,866 | B2 | 4/2008 | Snider et al. | |
| 7,565,930 | B2 | 7/2009 | Seekford | |
| 7,861,785 | B2 * | 1/2011 | Frazier et al. | 166/299 |
| 2002/0162662 | A1 | 11/2002 | Passamaneck et al. | |
| 2003/0155112 | A1 | 8/2003 | Tiernan et al. | |
| 2006/0124315 | A1 | 6/2006 | Frazier et al. | |

* cited by examiner

*Primary Examiner* — William P Neuder

(74) *Attorney, Agent, or Firm* — Edmonds & Nolte, P.C.

(57) ABSTRACT

A propellant assembly for subsurface fracturing and method for using the same are provided. The assembly can include a first tubular member having an annulus formed therethrough; a second tubular member at least partially disposed within the annulus of the first tubular member; one or more tubular propellants housed within the first tubular member, between an inner diameter of the first tubular member and an outer diameter of the second tubular member; and one or more detonating cords housed within the second tubular member, wherein the second tubular member has one or more portions thereof having a reduced wall thickness.

20 Claims, 6 Drawing Sheets

DOWNHOLE PERFORATION TOOL

REFERENCE TO RELATED APPLICATIONS

This application is a continuation of application Ser. No. 11/851,536, filed on Sep. 7, 2007, (now U.S. Pat. No. 7,861,785, issued Jan. 4, 2011) which claims benefit of U.S. Provisional Patent Application Ser. No. 60/846,920, filed on Sep. 25, 2006. The entirety of both is incorporated by reference herein.

BACKGROUND OF THE INVENTION

1. Field of the Invention

Embodiments of the present invention generally relate to a downhole tool for hydrocarbon production and method for using same. More particularly, embodiments of the present invention relate to a propellant assembly for subsurface fracturing and method for using same.

2. Description of the Related Art

To recover hydrocarbons from subterranean formations, a wellbore is drilled to some depth below the surface. The wellbore can then be lined with tubulars or casing to strengthen the walls of the borehole. To further strengthen the walls of the borehole, the annular area formed between the casing and the borehole can be filled with cement to permanently set the casing in the wellbore. The casing can then be perforated using a perforation tool that is lowered into the wellbore from the surface. The perforated casing allows the hydrocarbon fluids to enter the wellbore and flow to the surface of the well.

There is an increasing interest in producing hydrocarbon fluids from potentially productive geological formations that contain a sufficient volume of such fluids, but have low permeability so that production is slow or difficult. Low permeability can be naturally occurring due to the geological conditions of the formation. Low permeability can also be caused by damage to the formation from drilling, cementing, and perforating operations. Further, mature wells can incur similar damages in the form of migration of fine particulates, pipe scaling, wax buildup, and other conditions that reduce formation permeability and restrict flow.

One was to increase production and permeability within the formation is a technique known as artificial stimulation. One method of artificial stimulation is "well fracturing." Generally, a sufficient hydraulic pressure is applied against the formation to break or separate the earthen material to initiate a fracture in the formation. A fracture is an opening that extends laterally from the well and improves permeability within the formation so hydrocarbon fluids can flow.

The hydraulic pressure can be generated by pumping a fracturing fluid from the surface through the wellbore into the formation. Alternatively, hydraulic pressure can be generated by combusting propellants within the wellbore to expel high pressure gas. In this fashion, a work string having a perforating gun attached thereto is lowered into the well casing cemented into the wellbore. The perforating gun is positioned adjacent to the formation to be fractured. The perforating guns are then fired to produce an explosion of high pressure gas that is sufficient to penetrate the casing, surrounding cement, and formation.

Perforating guns known in the art utilize shaped propellant charges, such as those disclosed in U.S. Pat. Nos. 4,391,337; 6,006,833; and 6,851,471. US Publication 2003/0155112 discloses cylindrical propellant charge. However, there are numerous challenges to igniting such charges and producing long and even burn rates. Once ignited, short and fluctuating burn rates can limit fracture propagation and can increase the likelihood of damage to the wellbore.

Furthermore, fractures have a tendency to close or collapse once the pressure in the formation is relieved. To prevent such closing when the fracturing pressure is relieved, the fracturing fluid can include a granular or particulate material, referred to as a "proppant." The proppant is left behind in the fracture even after the fluid pressure is relieved. Ideally, the proppant holds the separated earthen walls of the formation apart to keep the fracture open and provides flow paths through which hydrocarbons from the formation can flow.

A variety of proppants have been used depending on the geological conditions of the formation. Proppants include particulate materials, such as sand, glass beads, and ceramic pellets, which create a porous structure. As such, the hydrocarbon fluid is able to flow through the interstices between the particulate material.

However, the pressure of the surrounding rock in the formation can crush the proppants over time. The resulting fines from this disintegration tend to migrate and plug the interstitial flow passages in the proppant. These migratory fines drastically reduce the permeability, lowering the conductivity of the hydrocarbon fluid. Conductivity is a measure of the ease with which the hydrocarbon fluid can flow through the proppant structure and is important to the productivity of a well. When the conductivity drops below a certain level, the fracturing process is repeated or the well is abandoned.

There is a need, therefore, for a new well tool and method for perforating and stimulating subterranean wells. There is also a need for a perforating tool that utilizes a proppant having a higher crush resistance.

SUMMARY OF THE INVENTION

A propellant assembly and methods for fracturing subsurface formations are provided. In at least one specific embodiment, the propellant assembly includes a first tubular member having an annulus formed therethrough; a second tubular member at least partially disposed within the annulus of the first tubular member; one or more tubular propellants housed within the first tubular member, between an inner diameter of the first tubular member and an outer diameter of the second tubular member; and one or more detonating cords housed within the second tubular member, wherein the second tubular member has one or more portions thereof having a reduced wall thickness.

A downhole tool utilizing one or more propellant assemblies and method for using the same are provided. In at least one specific embodiment, the downhole tool includes two or more propellant assemblies connected in series. Each propellant assembly includes a first tubular member having an annulus formed therethrough; a second tubular member at least partially disposed within the annulus of the first tubular member; one or more tubular propellants housed within the first tubular member, between an inner diameter of the first tubular member and an outer diameter of the second tubular member; and one or more detonating cords housed within the second tubular member, wherein the second tubular member has one or more portions thereof having a reduced wall thickness.

In at least one specific embodiment, the method comprises igniting a propellant assembly within a wellbore, the propellant assembly comprising: a first tubular member having an annulus formed therethrough; a second tubular member at least partially disposed within the annulus of the first tubular member; one or more tubular propellants housed within the first tubular member, between an inner diameter of the first tubular member and an outer diameter of the second tubular member; and one or more detonating cords housed within the second tubular member, wherein the second tubular member has one or more portions thereof having a reduced wall thickness. Igniting the propellant assembly comprises igniting the one or more detonating cords; separating the one or more portions of the second tubular member having a reduced wall thickness; burning the one or more tubular propellants to produce high pressure gas pulses; and fracturing the subsurface formations with the high pressure gas.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

As used herein, the terms "connect", "connection", "connected", "in connection with", and "connecting" refer to "in direct connection with" or "in connection with via another propellant assembly or member."

The terms "up" and "down"; "upper" and "lower"; "upwardly" and "downwardly"; "upstream" and "downstream"; "above" and "below"; and other like terms as used herein refer to relative positions to one another and are not intended to denote a particular spatial orientation.

Figure 1:
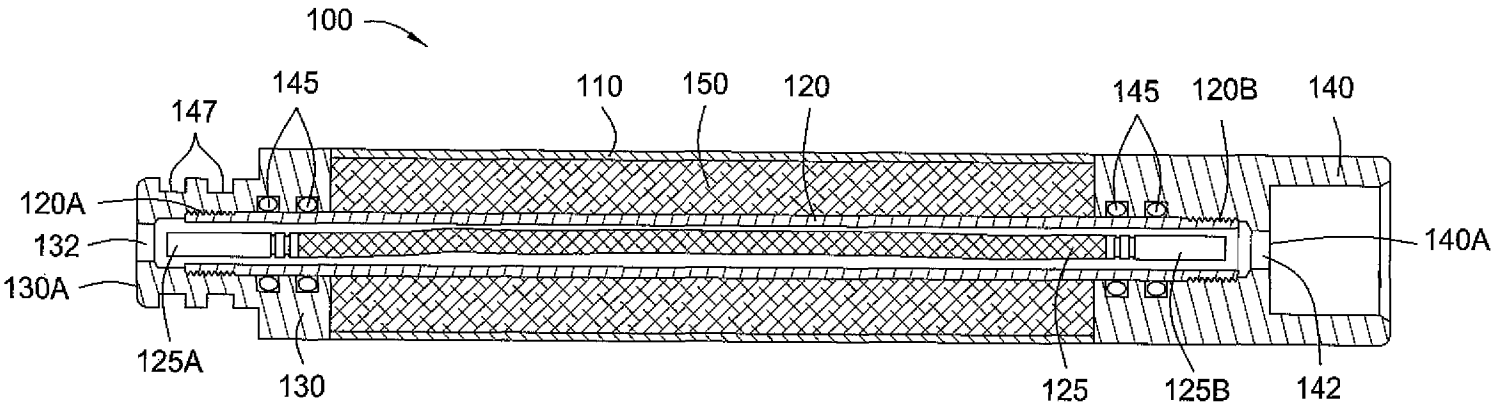
FIG. 1 depicts a partial cross-sectional view of an illustrative propellant assembly in accordance with one or more embodiments described.

FIG. 1 depicts a partial cross-sectional view of an illustrative propellant assembly. In one or more embodiments, the propellant assembly 100 includes a housing 110, ignition tube 120, first connector 130, second connector 140, propellant 150 and detonating cord 160. The housing 110 is a tubular member having an annulus formed therethrough. The connectors 130, 140 are disposed about a first and second end of the housing 110. In one or more embodiments, the housing 110 is a thin material or sleeve constructed of Glassin, Mylar, or Glassine, for example.

In one or more embodiments, the ignition tube 120 and propellant 150 are tubular members each having an annulus formed therethrough. At least a portion of the ignition tube 120 and propellant 150 are disposed within the inner diameter of the housing 110. In one or more embodiments, the ignition tube 120 and propellant 150 are concentric therewith. In one or more embodiments, the ignition tube 120 and propellant 150 are concentric therewith and concentric with the housing 110. For example, at least a portion of the ignition tube 120 can be disposed within the inner diameter of the propellant 150, and the propellant 150 having the ignition tube 120 at least partially disposed therein can be at least partially disposed within the inner diameter of the housing 110. Preferably, the entire length of the propellant 150 is housed within the annulus of the housing 110.

Figure 2:
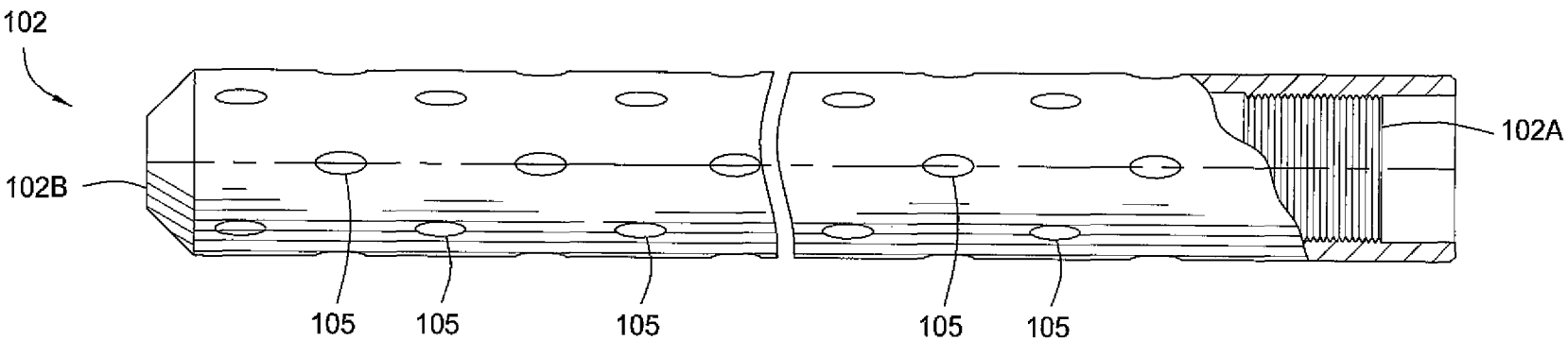
FIG. 2 depicts a partial plan view of a carrier having one or more holes or opening to provide explosion pathways therethrough.

FIG. 2 depicts a partial plan view of a carrier assembly 102. One or more propellant assemblies 100 described can be disposed within the carrier assembly 102. The carrier assembly 102 can be fabricated to any length depending on the number of propellant assemblies 100 required. The carrier assembly 102 can be fabricated from any suitable material for perforating wellbores, including but not limited to aluminum, steels, and alloys thereof. Preferably, the carrier assembly 102 is made of corrosion-resistant stainless steel.

In one or more embodiments, the carrier assembly 102 includes one or more holes or openings formed therethrough 105. The holes 105 serve as passageways or guides for the expelled gas from the ignited propellant 150. The holes 105 can be arranged in any pattern about the carrier assembly 102. The carrier assembly 102 can also include a threaded end 102A to threadably engage or otherwise connect to a firing gun, tubular or work string. Although not shown, the second end of the carrier 102B can be adapted to join or connect to one or more adjoining carriers 102, tubulars, firing guns, or tandem subs.

Considering the ignition tube 120 in more detail, the ignition tube 120 can also be constructed from any suitable material. Preferably, the ignition tube 120 is a stainless steel or alloy suitable to resist corrosion. Referring again to FIG. 1, the ignition tube 120 can be any length and preferably extends at least the entire length of the propellant 150. The ignition tube 120 houses one or more detonating cords 125 therein. In one or more embodiments, the ignition tube 120 has threaded ends 120A, 120B adapted to engage or otherwise connect to the end connectors 130, 140 having corresponding threads disposed thereon.

Figure 3:
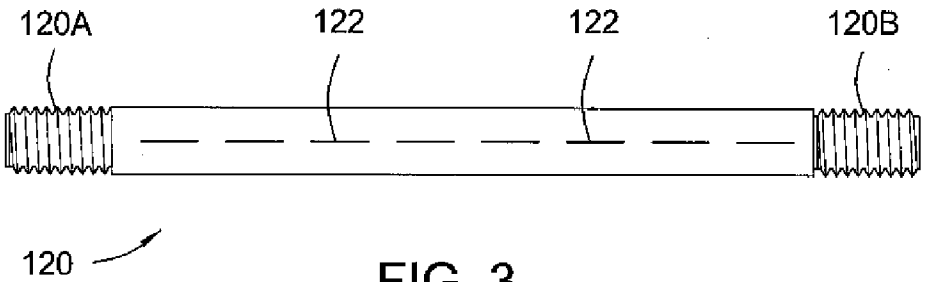
FIG. 3 depicts a simplified, schematic view of an ignition tube in accordance with one or more embodiments described.

FIG. 3 depicts a simplified, schematic view of an ignition tube 120 in accordance with one or more embodiments described. In one or more embodiments, the ignition tube 120 has one more sections or portions 122 having a reduced wall thickness to provide one or more weak points along the longitudinal axis thereof. For example, the inner or outer diameter of the ignition tube 120 can be milled, grooved, or scored to reduce the wall thickness thereof. FIG. 3 depicts the outer diameter of the ignition tube 120 having the one or more sections 122 reduced in thickness.

In one or more embodiments, the wall thickness of the ignition tube 120 can be reduced in at least a portion of the longitudinal axis thereof in one or more locations along the length thereof as depicted in FIG. 3. The entire longitudinal axis of the ignition tube 120 or any length short thereof can be continuously or intermittently milled, grooved or scored to produce a reduced wall thickness. In other words, such weak points 122 formed in the ignition tube 120 can be continuous or interrupted (i.e spaced apart in any fashion and pattern, either radially or longitudinally). Preferably, the ignition tube 120 is scored in a single, continuous straight line from end to end. As explained in more detail below, such one or more weak points allow the ignition tube 120 to more easily break or separate upon ignition of the detonating cord 125 therein, and provide a direct path or contact point between the detonating cord 125 and the propellant 150 disposed thereabout.

As mentioned, the detonating cord 125 is housed within the ignition tube 120. The detonating cord 125 provides the ignition source for the propellant 150. Preferably, the detonating cord 125 extends the entire length of the propellant 150 to provide a consistent and even burn. Detonating cords are known in the art and commercially available. Preferably, the detonating cord 125 has bi-directional boosters 125A, 125B located at each end thereof. The boosters 125A, 125B help transfer a charge from a firing gun to the cord, and help transfer the charge from cord to cord if one or more propellant assemblies are arranged in series. Any firing/perforating gun can be used. Suitable perforating guns are commercially available.

Considering the propellant 150 in more detail, the propellant 150 is preferably a tubular member having an annulus formed therethrough. The propellant 150 can made to any length and cross sectional area. The propellant 150 can be a single tubular member or one or more tubular members of varying lengths.

The propellant 150 can be made of any suitable gas propellant material. For example, the propellant 150 can include one or more solid fuel type materials, one more oxidizers, and one or more proppants. Illustrative fuels include but are not limited to metal powders such as aluminum and magnesium; and hydrocarbons such as epoxies and plastics; and other reducing agent materials. Illustrative oxidizers include but are not limited to perchlorates, chlorates, nitrates, and other oxygen rich materials. Illustrative proppants include but are not limited to sand, ceramics, silicon carbide and other non-combustible particulate materials.

In one or more embodiments, the propellant 150 includes an aluminum ore, such as bauxite. Preferably, the propellant 150 includes about 5 wt % to about 50 wt % of bauxite. In one or more embodiments, the propellant 150 includes bauxite in an amount ranging from a low of about 5 wt %, 6 wt %, or 7 wt % to a high of about 10 wt %, 20 wt % or 30 wt %.

It is believed that the bauxite is a stronger material than sand and ceramic materials, and will therefore, better abrade the casing perforations, perforation tunnels and create near-wellbore fractures in the producing formation. The stronger bauxite materials is also believed to withstand greater forces within the fracture and not crush or otherwise disintegrate over time, thereby serving as a better fracture proppant to hold open the fractures, allowing the unrestricted flow of hydrocarbons to the well for longer periods of time. As such, the efficiency and productivity of the well is vastly increased.

Considering the connectors 130, 140 in more detail, the connectors 130, 140 can each be male or female. More particularly, the first connector 130 can be a male or female end connector, and the second connector 140 can be a male or female end connector, depending on the use of the propellant assembly and its stacked arrangement on the downhole tool. In one or more embodiments, the first connector 130 is a male end connector and the connector 140 is a female end connector, as depicted in FIG. 1, such that the connectors 130, 140 are adapted to connect or otherwise engage complementary end connectors 130, 140 on adjacent propellant assemblies in an end-to-end arrangement. As such, two or more propellant assemblies can be stacked or fastened together in series.

In one or more embodiments, the first end connector 130 can have an opening 132 formed therethrough. The opening 132 provides an explosion pathway from a firing gun (not shown) or adjacent propellant assembly to the detonating cord 125. Similarly, the second end connector 140 can have an opening 142 formed therethrough to provide an explosion pathway from a first assembly to a second assembly stacked in series and so on.

As shown in FIG. 1, each end connector 130, 140 includes one or more o-rings 145 disposed on an inner diameter thereof. The o-rings 145 provide a fluid tight seal against the outer diameter of the ignition tube 125, preventing fluids from the wellbore from contacting the propellant 150 and detonation cord 125.

In one or more embodiments, the first end connector 130 also includes one or more o-rings 147 disposed about an outer diameter thereof. The o-rings 147 provide a fluid tight seal against either the firing gun or an adjacent propellant assembly, preventing fluids from the wellbore from contacting the propellant 150 and detonation cord 125.

Figure 4:
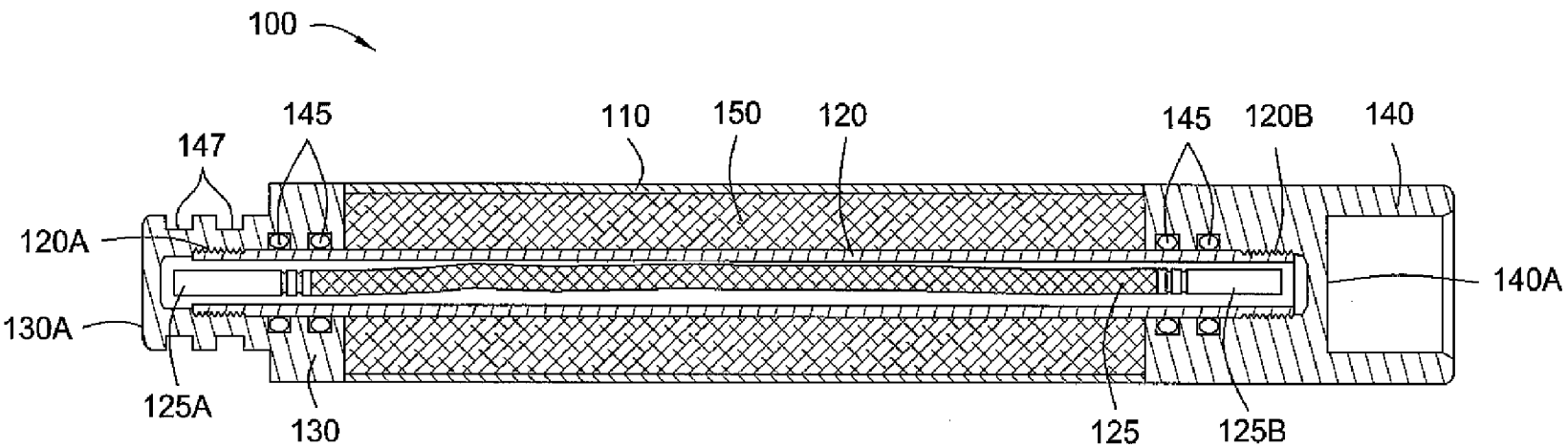
FIG. 4 depicts a partial cross-sectional view of another illustrative propellant assembly in accordance with one or more embodiments described. The propellant assembly shown has one or more sealed end connectors.

FIG. 4 depicts a partial cross-sectional view of another illustrative propellant assembly. As shown, the first and second end connectors 130, 140 can be completely sealed at the ends 130A, 140A thereof. Accordingly, the detonating cord 125 and propellant 150 are completely sealed within the propellant assembly. The detonating cord 125 can be ignited by a charge shooting through the bulk head of an adjoining firing/perforating gun or other propellant assembly.

Figure 5:
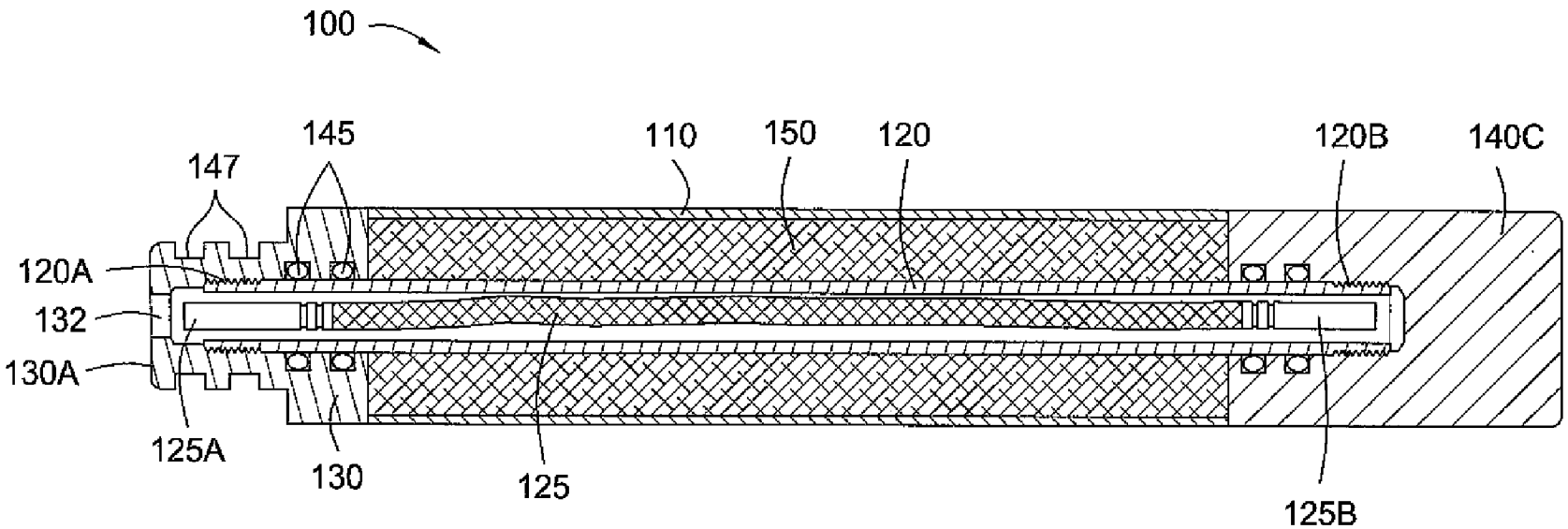
FIG. 5 depicts a partial cross-sectional view of yet another illustrative propellant assembly in accordance with one or more embodiments described. The propellant assembly shown has a capped second end.

FIG. 5 depicts a partial cross-sectional view of yet another illustrative propellant assembly. As shown, the second end connector can be capped end connector 140C. A capped second end 140C would identify a single propellant assembly or the end of a stacked arrangement of two or more assemblies in series.

Figure 6:
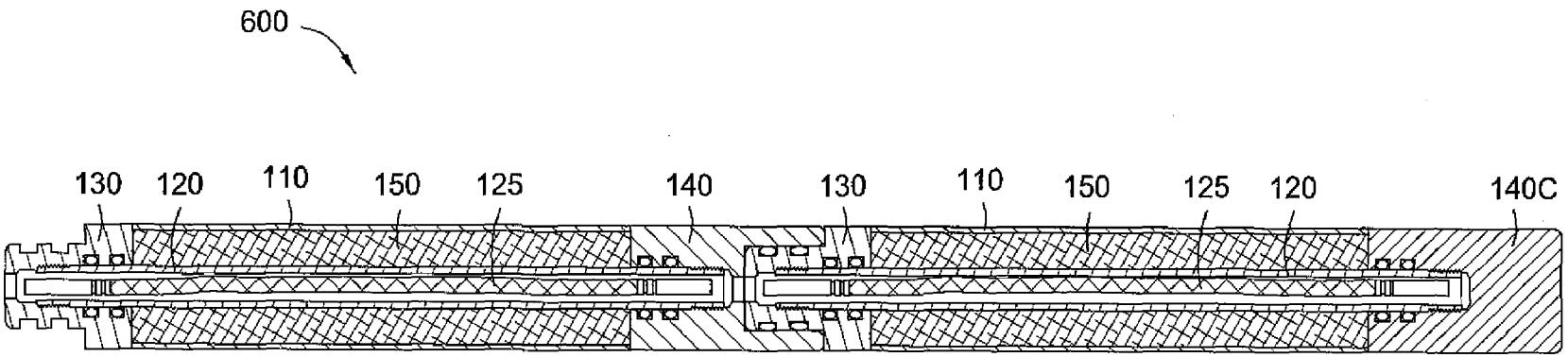
FIG. 6 depicts a schematic of two or more propellant assemblies stacked in series.

FIG. 6 depicts a schematic of two or more propellant assemblies 100 stacked in series ("propellant assembly tandem") 600. If two or more propellant assemblies are to be stacked in series, the male end of the first connector 130 of a first propellant assembly is inserted into the female end of the second connector 140 of a second propellant assembly 100 as depicted in FIG. 1. Accordingly, the o-rings 147 disposed on the outer diameter of the first end connector 130 sealingly engage the inner diameter of the second end connector 140, providing a fluid tight seal therebetween. Additional propellant assemblies can be attached in a similar fashion.

In operation, a perforating gun (not shown for simplicity) having one or more propellant assemblies 100 attached thereto is lowered into the wellbore using a wireline, production tubing, coiled tubing, or any combination thereof to a desired depth. The perforating gun ignites the detonating cord 125 housed within the ignition tube 120 and provides the ignition source for the propellant 150. That ignition source breaks or separates the ignition tube 120 at the weak points formed therein, creating a direct contact between the detonating cord 125 and the propellant 150. The propellant 150 is thereby ignited and combusted. As the propellant 150 burns a high-pressure gas pulse is produced and forced through the holes/apertures 105 formed in the surrounding carrier assembly 102. The forces generated from the expulsion of the high pressure gas are sufficient to causes fractures in the surrounding formation.

In embodiments where the propellant 150 contains bauxite, the bauxite is expelled into the surrounding fractures and acts as a proppant to prevent closures of the formation fractures after the pressure is relieved. Accordingly, improved communication of the formation hydrocarbons within the wellbore is achieved, as is increased production rates.

In situations where multiple zones are involved or the operator requires additional charge, multiple sets of one or more assemblies 100 can be joined together via a transfer sub. For example, one or more propellant assemblies 100 can be disposed within a first carrier 102 and one or more propellant assemblies 100 can be disposed within a second carrier 102. A propellant transfer sub can be used to join the carriers 102. An illustrative transfer sub 700 is described with reference to FIGS. 7, 7A and 7B.

Figure 7:
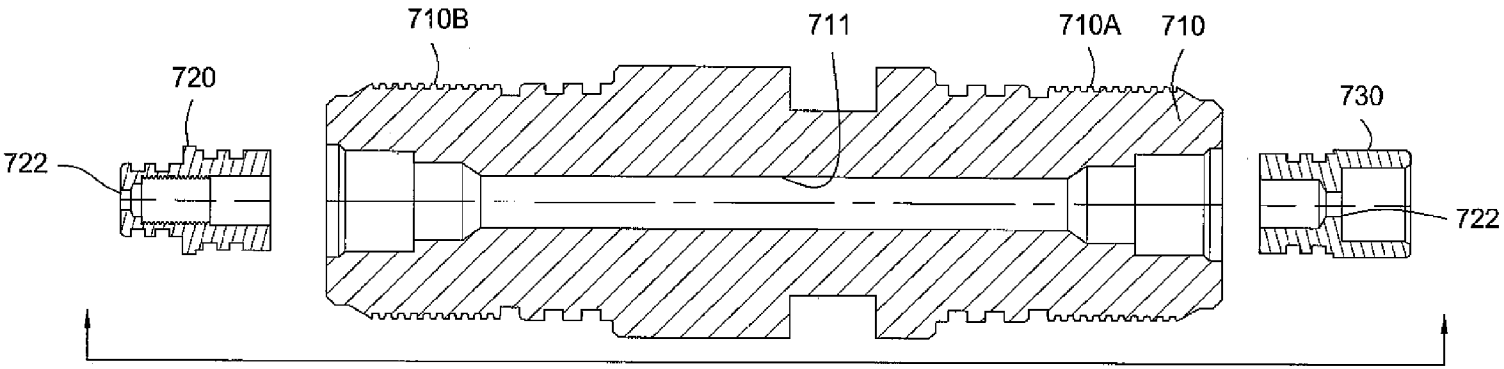
FIG. 7 depicts a schematic cross section of a propellant transfer sub housing and couples according to one or more embodiments described.

FIG. 7 depicts a schematic cross section of a propellant transfer sub housing 710 and couplers 720, 730 according to one or more embodiments described. In one or more embodiments, the propellant transfer sub ("tandem sub") housing 710 includes a first threaded end 710A, second threaded end 710B, and a bore or passageway 711 formed therethrough. The threaded ends 710A, 710B can each be threadably connected to an adjoining carrier 102 having one or more propellant assemblies 100 disposed therein or one or more firing guns.

In one or more embodiments, a male coupler 720 or female coupler 730 can be disposed at either end 710A, 710B of the housing 710. The couplers 720, 730 can each include a central passageway 722 for transmitting a charge therethrough. The couplers 720, 730 are adapted to slide into the respective ends of the housing 710.

Figure 7A:
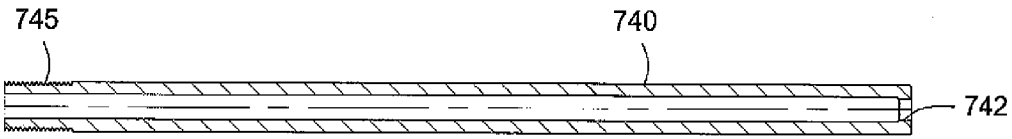
FIG. 7A depicts a schematic cross section of an ignition tube that can be used with the propellant transfer sub depicted in FIG. 7.

One or more ignition tubes 740 can be disposed within the housing 710. FIG. 7A depicts a schematic cross section of an illustrative ignition tube 740 that can be used with the propellant transfer sub depicted in FIG. 7. In one or more embodiments, the ignition tube 740 includes at least one threaded end 745 to connect to at least one of the couplers 720, 730. In one or more embodiments, the ignition tuber 740 includes an opening or passageway 742 having a smaller inner diameter than the remaining tube 740. The smaller passageway 742 is meant to focus or direct a charge passing therethrough to an adjoining detonation cord (not shown) via the passageways 722 formed within the couplers 720, 730.

Figure 7B:
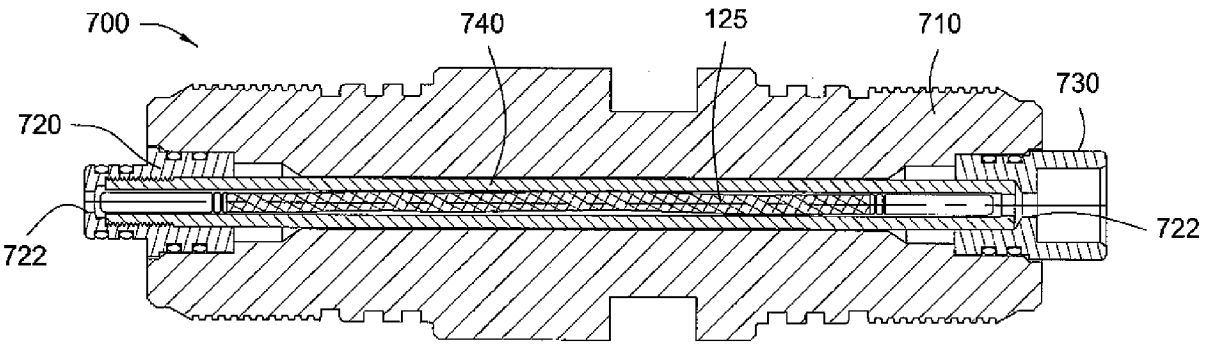
FIG. 7B depicts a schematic cross section of an assembled propellant transfer sub according to one or more embodiments described.

FIG. 7B depicts a schematic cross section of an assembled propellant transfer sub 700 according to one or more embodiments described. As shown, the detonation cord 125 is contained within the ignition tube 740. The ignition tube 740 is connected to the first coupler 720 at a first end thereof and the second coupler 730 at a second end thereof. The transfer sub 700 can be disposed between two or more propellant assemblies 100. For example, the first end 710B can be connected to a firing gun or first propellant assembly 100 and the second end 710A can be connected to a second propellant assembly 100. Any number of transfer subs 700 and propellant assemblies 100 can be used in tandem to form a train as each assembly 100, 700 is adapted to conduct and/or transfer an electric charge from one to another. As such, only one firing gun at the head of the train is needed although more than one can be used.

Figure 8:
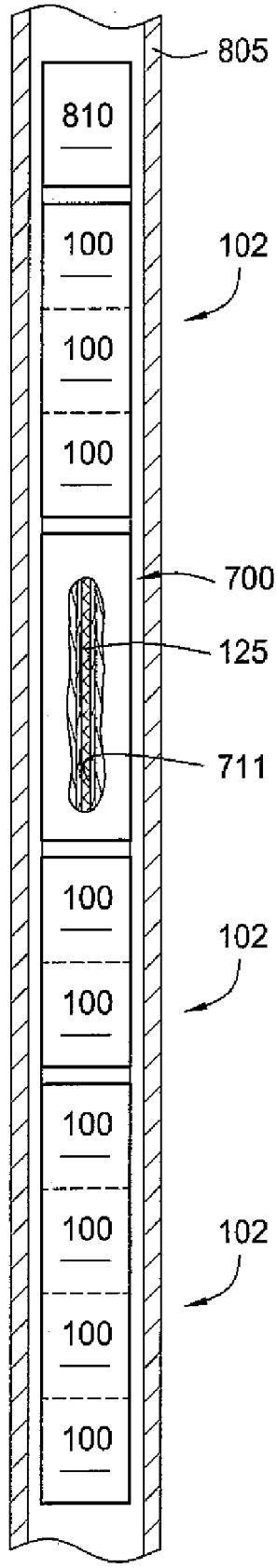
FIG. 8 is a schematic illustration of an illustrative propellant train disposed within a wellbore.

FIG. 8 is a schematic illustration of an illustrative propellant train disposed within a wellbore 805. The wellbore 805 can be lined with casing or not. In one or more embodiments, the train 800 includes two or more propellant carriers 102 having one or more propellant assemblies 100 disposed therein. The propellant carriers 102 are connected via one or more propellant transfer subs 700. The train 800 also includes a firing gun 810 located at a front end thereof.

In operation, the train 800 can be lowered into the wellbore 805 via a wireline, slickline, production tubing, coiled tubing or any technique known or yet to be discovered in the art. An electric charge is sent to the firing gun 810 which transfers and/or passes the charge into the first propellant assembly 100 disposed within the first carrier 102. The charge is then passed through the detonation cords 125 disposed therein to the tandem sub 700. The sub assembly 700 transfers the charge to the propellant assemblies 100 within the second carrier 102.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A downhole tool for subsurface fracturing, comprising:

first and second propellant assemblies, each propellant assembly comprising:

a first tubular member having an annulus formed therethrough;

a second tubular member at least partially disposed within the annulus of the first tubular member;

one or more tubular propellants housed within the first tubular member, between an inner diameter of the first tubular member and an outer diameter of the second tubular member;

one or more detonating cords housed within the second tubular member, wherein the second tubular member has one or more portions thereof having a reduced wall thickness, wherein the first and second tubular members are substantially concentric to one another; and first and second end connectors disposed at opposite ends of the first tubular member, wherein the second tubular member has threaded ends adapted to engage the first and second end connectors;

a male coupler having a first side and a second side, the second side being adapted to be received into the first end connector of either one of the first and second propellant assemblies;

a female coupler having a first side and a second side, the second side being adapted to receive the second end connector of either one of the first and second propellant assemblies; and a transfer sub housing disposed between the first and second propellant assemblies, the transfer sub housing having first and second ends, wherein the first sides of the male and female couplers are adapted to couple to either of the first and second ends of the transfer sub housing.

2. The tool of claim 1, further comprising:

a first plurality of propellant assemblies including the first propellant assembly; and a second plurality of propellant assemblies including the second propellant assembly.

3. The tool of claim 2, wherein:

the first end connector of at least one of the first plurality of propellant assemblies is adapted to engage the second end connector of another one of the first plurality of propellant assemblies such that at least two of the first plurality of propellant assemblies are stacked together in series; and the first end connector of at least one of the second plurality of propellant assemblies is adapted to engage the second end connector of another one of the second plurality of propellant assemblies such that at least two of the second plurality of propellant assemblies are stacked together in series.

4. The tool of claim 1, wherein each propellant assembly further comprises a third tubular member disposed about the first tubular member, wherein the third tubular member includes one or more openings formed therethrough.

5. The tool of claim 1, wherein at least one of the first and second end connectors of the first and second propellant assemblies defines a substantially unobstructed opening that is communicable between the second tubular member and a bore of the transfer sub housing.

6. The tool of claim 1, further comprising a perforating gun connected to at least one of the first and second propellant assemblies.

7. The tool of claim 1, wherein the tool is adapted to be lowered into a wellbore on a wireline, production tubing, coiled tubing, or any combination thereof.

8. The tool of claim 1, wherein the second tubular member of the first and second propellant assemblies has a reduced wall thickness along an entire length thereof.

9. The tool of claim 1, wherein, in at least one of the first and second propellant assemblies, the portions thereof having a reduced wall thickness are spaced longitudinally along the second tubular member.

10. The tool of claim 1, wherein, in at least one of the first and second propellant assemblies, the portions thereof having a reduced wall thickness are spaced radially about the second tubular member.

11. The tool of claim 1, wherein the one or more tubular propellants of the first and second propellant assemblies each comprise propellant material and proppant material.

12. The tool of claim 11, wherein the proppant material comprises bauxite.

13. The tool of claim 1, wherein the one or more tubular propellants of the first and second propellant assemblies each comprise from about 5 wt % to about 50 wt % of bauxite.

14. A method for fracturing subsurface formations, comprising:

deploying a downhole tool into a wellbore, the downhole tool comprising:

first and second propellant assemblies, each propellant assembly comprising:

a first tubular member having an annulus formed therethrough;

a second tubular member at least partially disposed within the annulus of the first tubular member;

one or more tubular propellants housed within the first tubular member, between an inner diameter of the first tubular member and an outer diameter of the second tubular member;

one or more detonating cords housed within the second tubular member, wherein the second tubular member has one or more portions thereof having a reduced wall thickness, wherein the first and second tubular members are substantially concentric to one another; and a first end connector and a second end connector disposed at opposite ends of the first tubular member, wherein the second tubular member has threaded ends adapted to engage the first and second end connectors;

a male coupler having a first side and a second side, the second side being adapted to be received into the first end connector of either one of the first and second propellant assemblies;

a female coupler having a first side and a second side, the second side being adapted to receive the second end connector of either one of the first and second propellant assemblies; and a transfer sub housing disposed between the first and second propellant assemblies, the transfer sub housing having first and second ends, wherein the first sides of the male and female couplers are adapted to couple to either of the first and second ends of the transfer sub housing;

igniting the one or more detonating cords of the first propellant assembly;

separating the one or more portions of the second tubular member having a reduced wall thickness of the first propellant assembly;

transferring a charge from the one or more detonating cords of the first propellant assembly, through the transfer sub, to the one or more detonating cords of the second propellant assembly to ignite the second propellant assembly;

burning the one or more tubular propellants of the first and second propellant assemblies to produce high pressure gas pulses; and fracturing the subsurface formations with the high pressure gas.

15. The method of claim 14, further comprising:

igniting one or more additional propellant assemblies connected in series to the first propellant assembly; and igniting one or more additional propellant assemblies connected in series to the second propellant assembly.

16. The method of claim 14, wherein the one or more tubular propellants of the first and second propellant assemblies comprise a propellant material and a proppant material.

17. The method of claim 16, wherein the proppant material comprises bauxite.

18. The method of claim 14, wherein each of the first and second propellant assemblies further comprises a third tubular member disposed about the first tubular member, wherein the third tubular member comprises one or more openings formed therethrough.

19. A downhole tool for subsurface fracturing, comprising:

first and second propellant assemblies, each propellant assembly comprising:

a first tubular member having an annulus formed therethrough;

a second tubular member at least partially disposed within the annulus of the first tubular member;

one or more tubular propellants housed within the first tubular member, between an inner diameter of the first tubular member and an outer diameter of the second tubular member;

one or more detonating cords housed within the second tubular member, wherein the second tubular member has one or more portions thereof having a reduced wall thickness, wherein the first and second tubular members are substantially concentric to one another; and a first end connector and a second end connector disposed at opposite ends of the first tubular member, wherein the second tubular member has threaded ends adapted to engage the first and second end connectors;

a male coupler having a first side and a second side, the second side being adapted to be received into the first end connector of either one of the first and second propellant assemblies;

a female coupler having a first side and a second side, the second side being adapted to receive the second end connector of either one of the first and second propellant assemblies; and a transfer sub housing disposed between the first and second propellant assemblies, the transfer sub housing having first and second ends, wherein the transfer sub is reversible such that each of the first and second ends is sized to engage either of the first ends of the male and female couplers.

20. The tool of claim 19, further comprising:

a third propellant assembly connected in series to the first propellant assembly; and a fourth propellant assembly connected in series to the second propellant assembly.

* * * * *